US008726995B2

(12) United States Patent
Bell et al.

(10) Patent No.: US 8,726,995 B2
(45) Date of Patent: May 20, 2014

(54) METHOD FOR THE ENHANCEMENT OF DYNAMIC UNDERBALANCED SYSTEMS AND OPTIMIZATION OF GUN WEIGHT

(75) Inventors: Matthew Robert George Bell, Dallas, TX (US); David S. Wesson, Dallas, TX (US); Nathan Garret Clark, Mansfield, TX (US); John Thomas Hardesty, Dallas, TX (US)

(73) Assignee: Geodynamics, Inc., Millsap, TX (US)

( * ) Notice: Subject to any disclaimer, the term of this patent is extended or adjusted under 35 U.S.C. 154(b) by 146 days.

(21) Appl. No.: 12/627,930

(22) Filed: Nov. 30, 2009

(65) Prior Publication Data

US 2010/0133005 A1 Jun. 3, 2010

Related U.S. Application Data

(60) Provisional application No. 61/118,997, filed on Dec. 1, 2008.

(51) Int. Cl.
*E21B 43/118* (2006.01)
*E21B 43/119* (2006.01)

(52) U.S. Cl.
USPC ..... 166/297; 166/55

(58) Field of Classification Search
USPC ..... 166/297, 299, 55
See application file for complete search history.

(56) References Cited

U.S. PATENT DOCUMENTS

| | | | | |
|---|---|---|---|---|
| 3,235,005 | A | 2/1966 | Delacour | |
| 3,983,941 | A | 10/1976 | Fitch | |
| 4,078,612 | A | 3/1978 | Gallus | |
| 4,107,057 | A | 8/1978 | Dill et al. | |
| 4,220,205 | A | 9/1980 | Coursen et al. | |
| 4,372,384 | A | 2/1983 | Kinney | |
| 4,436,155 | A * | 3/1984 | Brieger | 166/297 |
| 5,318,128 | A | 6/1994 | Johnson et al. | |
| 6,732,298 | B1 | 5/2004 | Murthy et al. | |
| 6,962,203 | B2 | 11/2005 | Funchess | |
| 7,036,594 | B2 | 5/2006 | Walton et al. | |
| 7,121,340 | B2 | 10/2006 | Grove et al. | |
| 7,393,423 | B2 | 7/2008 | Liu | |
| 7,712,416 | B2 | 5/2010 | Pratt et al. | |
| 2002/0020535 | A1 * | 2/2002 | Johnson et al. | 166/363 |
| 2003/0037692 | A1 * | 2/2003 | Liu | 102/301 |
| 2003/0089498 | A1 * | 5/2003 | Johnson et al. | 166/297 |
| 2004/0089449 | A1 * | 5/2004 | Walton et al. | 166/297 |

(Continued)

OTHER PUBLICATIONS

Entry for "homogeneous formation" from the Schlumberger Oilfield Glossary, accessed Jun. 8, 2012 via www.glossary.oilfield.slb.com.*

(Continued)

*Primary Examiner* — Blake Michener
(74) *Attorney, Agent, or Firm* — David W. Carstens; Shaukat A. Karjeker; Carstens & Cahoon, LLP

(57) ABSTRACT

By using reactive shaped charges, a dynamic underbalance effect associated with detonation of a perforating system is enhanced without compromising shot density. Fewer shaped charges can be loaded to achieve the same or better effective shot density as a gun fully loaded with conventional shaped charges, thereby increasing the free volume within the gun while creating debris-free tunnels with fractured tips and substantially eliminating the crushed zone surrounding each perforated tunnel. Further, the strength and grade of gun steel required to construct the gun can be reduced without compromising the amount the gun swells following detonation.

17 Claims, 5 Drawing Sheets

(56) References Cited

U.S. PATENT DOCUMENTS

| | | | | |
|---|---|---|---|---|
| 2005/0115448 | A1 | 6/2005 | Pratt et al. | |
| 2006/0266551 | A1 | 11/2006 | Yang et al. | |
| 2007/0056462 | A1 | 3/2007 | Bates et al. | |
| 2008/0105430 | A1* | 5/2008 | Cuthill | 166/297 |
| 2008/0271894 | A1 | 11/2008 | Hill et al. | |
| 2010/0132945 | A1* | 6/2010 | Bell et al. | 166/297 |
| 2010/0132946 | A1* | 6/2010 | Bell et al. | 166/298 |
| 2012/0018156 | A1* | 1/2012 | Grove et al. | 166/297 |

OTHER PUBLICATIONS

GEODynamics Engineered Perforating Solutions, 2009 GEODynamics Inc., Client Spotlight, Jul. 2009.

GEODynamics Engineered Perforating Solutions, 2008.10 GEODynamics, Inc., CONNEX Perforating, ReActive Perforating Technology.

Bell, Hardesty, and Clark, "Reactive Perforating: Conventional and Unconventional Applications, Learnings, and Opportunities," SPE 122174, 2009 Society of Petroleum Engineers, May 27, 2009.

Bell and Cuthill, "Next-Generation Perforating System Enhances the Testing and Treatment of Fracture Stimulated Wells in Canada," SPE 116226, 2008, Society of Petroleum Engineers, Sep. 21, 2008.

Denney, "Technology Applications," JPT Online, Jul. 2007, located at http://www.spe.org/spe-app/spe/jpt/2007/07/TechApps.htm, downloaded Nov. 28, 2009.

Wade et al. "Field Tests Indicate New Perforating Devices Improve Efficiency in Casing Completion Operations" Schlumberger Well Surveying Corp. Oct. 1962, pp. 1069-1073.

* cited by examiner $P_{WB} < P_{RES}$

METHOD FOR THE ENHANCEMENT OF DYNAMIC UNDERBALANCED SYSTEMS AND OPTIMIZATION OF GUN WEIGHT

CROSS-REFERENCE TO RELATED APPLICATION

This application claims priority to provisional application Ser. No. 61/118,997, filed Dec. 1, 2008.

TECHNICAL FIELD

The present invention relates generally to reactive shaped charges used in the oil and gas industry to explosively perforate well casing and underground hydrocarbon bearing formations, and more particularly to an improved method for explosively perforating a well casing and its surrounding underground hydrocarbon bearing formation while enhancing the efficacy of dynamic underbalanced systems and reducing overall shot density and cost.

BACKGROUND OF THE INVENTION

Wellbores are typically completed with a cemented casing across the formation of interest to assure borehole integrity and allow selective injection into and/or production of fluids from specific intervals within the formation. It is necessary to perforate this casing across the interval(s) of interest to permit the ingress or egress of fluids. Several methods are applied to perforate the casing, including mechanical cutting, hydrojetting, bullet guns and shaped charges. The preferred solution in most cases is shaped charge perforation because a large number of holes can be created simultaneously, at relatively low cost. Furthermore, the depth of penetration into the formation is sufficient to bypass near-wellbore permeability reduction caused by the invasion of incompatible fluids during drilling and completion.

FIG. 1 illustrates a perforating gun 10 consisting of a cylindrical charge carrier 14 with explosive charges 16 (also known as perforators) introduced into the well casing on a cable, wireline, coiled tubing or assembly of jointed pipes 20. Any technique known in the art may be used to deploy the carrier 14 into the well casing. At the well site, the explosive charges 16 are placed into the charge carrier 14, and the charge carrier 14 is then lowered into the oil and gas well casing to the depth of a hydrocarbon bearing formation 12. The explosive charges 16 fire outward from the charge carrier 14 and puncture holes in the wall of the casing and the hydrocarbon bearing formation 12. As best depicted in FIG. 2, the tunnels created through the casing wall and into the formation 12 are relatively narrow. As the charge jet penetrates the rock formation 12 it decelerates until eventually the jet tip velocity falls below the critical velocity required for it to continue penetrating. Particulate debris 22 created during perforation leads to plugged tunnel tips 18 that obstruct the production of oil and gas from the well.

Perforation using shaped explosive charges is inevitably a violent event, resulting in plastic deformation of the penetrated rock, grain fracturing, and the compaction of particulate debris (casing material, cement, rock fragments, shaped charge fragments) into the pore throats of rock surrounding the tunnel. Thus, while perforating guns do enable fluid production from hydrocarbon bearing formations, the effectiveness of traditional perforating guns is limited by the fact that the firing of a perforating gun leaves debris 22 inside the perforation tunnel and the wall of the tunnel. Moreover, the compaction of particulate debris into the surrounding pore throats results in a zone 26 of reduced permeability (disturbed rock) around the perforation tunnel commonly known as the "crushed zone." The crushed zone 26, though only about one quarter inch thick around the tunnel, detrimentally affects the inflow and/or outflow potential of the tunnel (commonly known as a "skin" effect.) Plastic deformation of the rock also results in a semi-permanent zone of increased stress 28 around the tunnel, known as a "stress cage", which further impairs fracture initiation from the tunnel. The compacted mass of debris left at the tip of the tunnel is typically very hard and almost impermeable, further reducing the inflow and/or outflow potential of the tunnel and the effective tunnel depth (also known as clear tunnel depth).

The distance a perforated tunnel extends into the surrounding formation, commonly referred to as total penetration, is a function of the explosive weight of the shaped charge; the size, weight, and grade of the casing; the prevailing formation strength; and the effective stress acting on the formation at the time of perforating. Effective penetration is the fraction of the total penetration that contributes to the inflow or outflow of fluids. This is determined by the amount of compacted debris left in the tunnel after the perforating event is completed. The effective penetration may vary significantly from perforation to perforation. Currently, there is no means of measuring it in the borehole. Darcy's law relates fluid flow through a porous medium to permeability and other variables, and is represented by the equation seen below.

$$q = \frac{2\pi kh(p_e - p_w)}{\mu\left[\ln\left(\frac{r_e}{r_w}\right) + S\right]}$$

Where: q=flowrate, k=permeability, h=reservoir height, $p_e$=pressure at the reservoir boundary, $p_w$=pressure at the wellbore, t=fluid viscosity, $r_e$=radius of the reservoir boundary, $r_w$=radius of the wellbore, and S=skin factor.

The effective penetration determines the effective wellbore radius, $r_w$, an important term in the Darcy equation for radial inflow. This becomes even more significant when near-wellbore formation damage has occurred during the drilling and completion process, for example, resulting from mud filtrate invasion. If the effective penetration is less than the depth of the invasion, fluid flow can be seriously impaired.

To minimize perforating damage and optimize production of a tunnel, current procedures to clear debris from tunnels rely on applying a relatively large pressure differential between the formation and the wellbore, or underbalance, wherein the formation pressure is greater than the wellbore pressure. These methods attempt to enhance tunnel cleanout by controlling the static and dynamic pressure behavior within the wellbore prior to, during and immediately following the perforating event so that a pressure gradient is maintained from the formation toward the wellbore, inducing tensile failure of the damaged rock around the tunnel and a surge of flow to transport debris from the perforation tunnels into the wellbore. FIG. 3 depicts the cleaning surge flow in an underbalanced situation after explosive charges 16 are fired. As the fluid flows through the tunnels and egresses through the tunnel openings 24, it takes with it the debris 22 formed as a result of perforation. However, if the reservoir pressure and/or formation permeability is low, or the wellbore pressure cannot be lowered substantially, there may be insufficient driving force to remove the debris.

Thus, in a number of situations, it is difficult or even impossible to create a sufficient pressure gradient between the formation and the wellbore. For example, in heterogeneous formations—where rock properties such as hardness and permeability vary significantly within the perforation interval—and in formations of high-strength, high effective stress and/or low natural permeability, underbalanced techniques become increasingly less effective. Since all the tunnels are being cleaned up in parallel by a common pressure sink, perforations shot into zones of relatively higher permeability will preferentially flow and clean up, eliminating the pressure gradient before perforations shot into poorer rock are able to flow. Since the maximum pressure gradient is limited by the difference between the reservoir pressure and the minimum hydrostatic pressure that can be achieved in the wellbore, perforations shot into low permeability rock may never experience sufficient surge flow to clean up. In such circumstances the perforation efficiency may be as low as 10% of the total holes perforated.

To solve these problems, methods have been developed for creating a dynamic underbalance around the gun immediately after creating perforated tunnels. For, example, U.S. Pat. No. 7,121,340 discloses a pressure reducer positioned adjacent to a perforating gun for reducing post-detonation pressure within the gun to enhance the dynamic underbalance effect within the gun and cause well-bore fluid to flow into the gun. U.S. Pat. No. 6,732,298 uses a porous solid around a perforation gun, which is crushed when the gun is detonated to produce a new volume into which wellbore fluids can flow, thereby enhancing the transient pressure around the gun. Others take advantage of the volume within the gun to create a dynamic underbalance. However, this generally calls for a reduction in the number of shaped charges within the gun and therefore, a reduction in shot density and an increased risk of low perforation efficiency. Low perforation efficiency, inadequately cleaned tunnels and/or insufficient shot density limits the overall inflow and/or outflow potential of the well and the area through which fluids can flow, causing increased pressure drop and erosion and impairing fracture initiation and propagation. Consequently, there is a need for a method of creating dynamic underbalance while ensuring that substantially every charge effectively produces and substantially clears a tunnel.

SUMMARY OF THE INVENTION

Accordingly, the present invention provides a method of reducing the effects experienced when using conventional perforators in heterogeneous formations. In particular, the proposed method allows for the enhancement of a dynamic underbalance effect without a decrease in overall perforation efficiency by using reactive shaped charges within the charge carrier of a perforation gun. Thus, it provides an improved method for reducing the shot density to create a dynamic underbalance while delivering a greater overall number of effective perforations. Despite reducing the number of charges within the gun, and allowing a reduction in shot density, effective shot density is not compromised. Moreover, the propensity for gun swell is reduced thereby reducing the risk of difficulty retrieving spent guns from the wellbore. In addition, the method proposed herein achieves a superior inflow and outflow performance compared to that achieved with conventional shaped charges under the same perforating conditions. It further enhances the parameters and effects of injection to enhance and stimulate the production of oil and gas.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
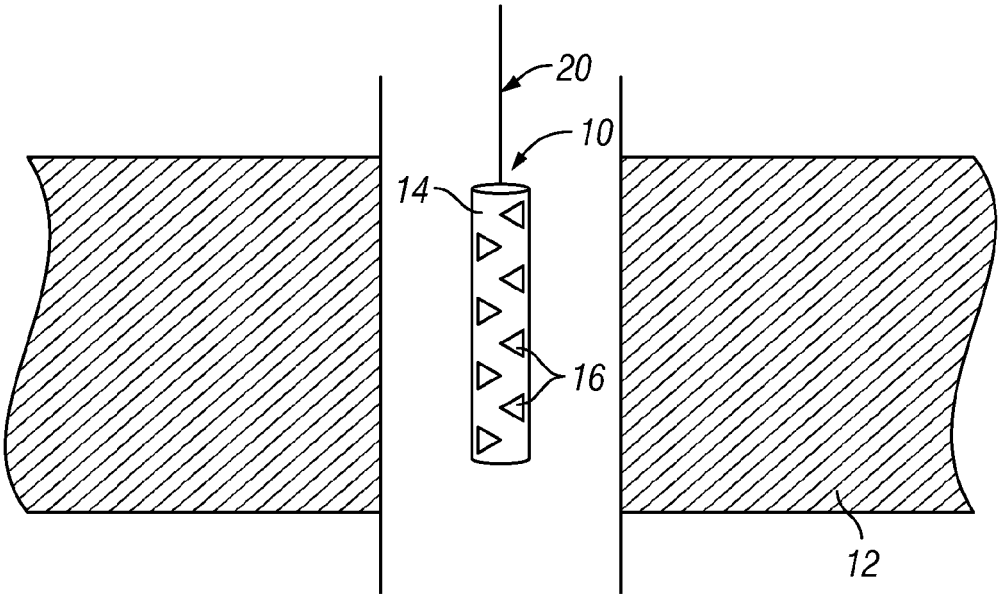
FIG. 1 (Prior Art)
FIG. 1 is a cross-sectional view of a prior art perforating system inside a well casing.
Figure 2:
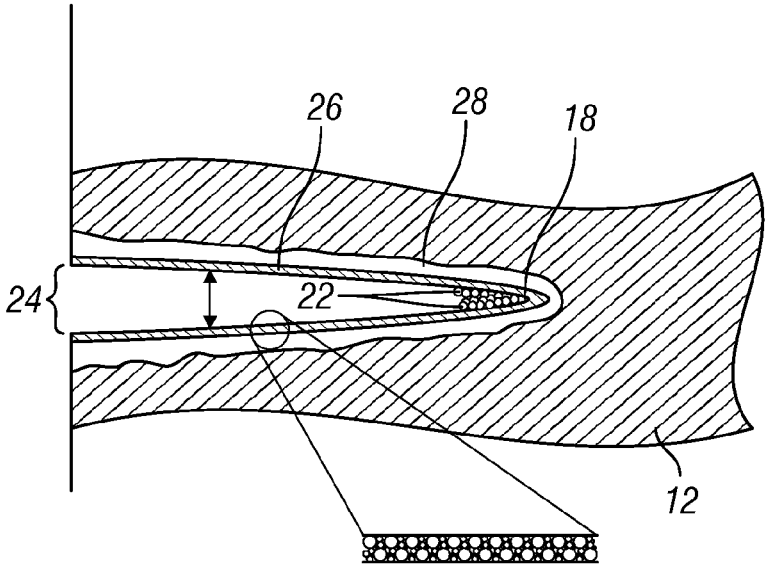
FIG. 2 (Prior Art)
FIG. 2 is a cross-sectional close up view of the compacted fill experienced within a perforation tunnel as a result of prior art methods.
Figure 3:
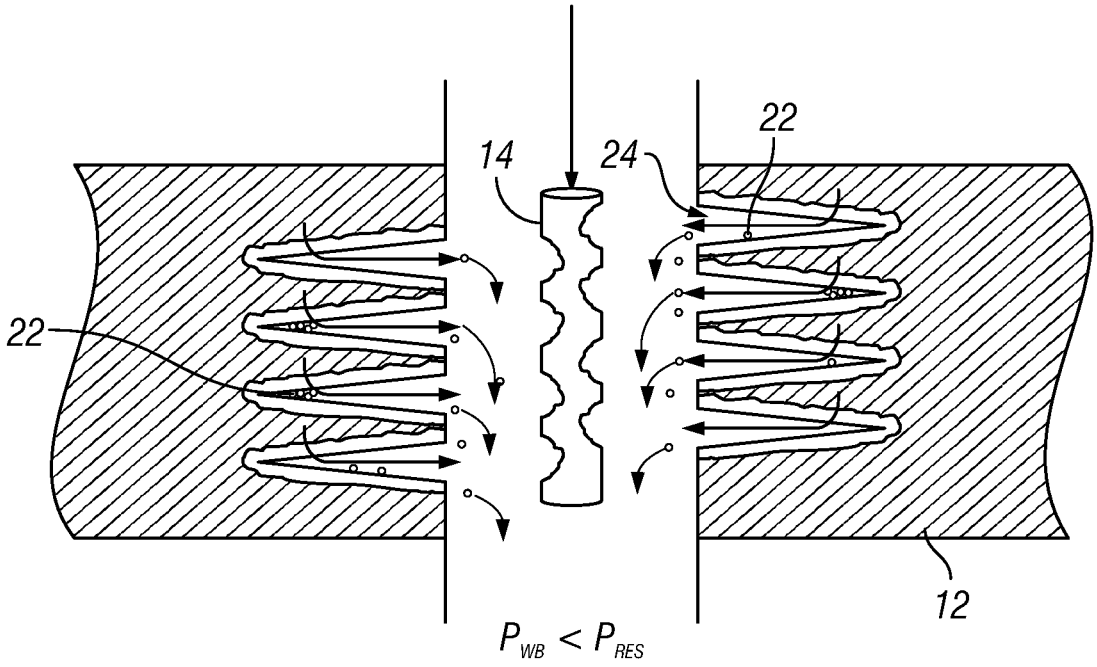
FIG. 3 (Prior Art)
FIG. 3 is a cross-sectional view of a spent conventional perforation device utilizing prior art underbalance methods to clean a perforation tunnel.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE PREFERRED EMBODIMENTS

The present invention provides an improved method for the perforation of a wellbore and the creation of a local dynamic underbalance effect within a charge carrier without comprising shot density. In adjusting the free volume of the gun to create a dynamic underbalance, there is a trade off between cleaning out the debris from within a perforated tunnel and a reduction in the total number of holes perforated. In order to maximize the sustained dynamic underbalance pressure within and around a perforating gun, the free gun volume must be increased, resulting in less total shots into the formation. That is, by reducing the number of shaped charges loaded within a perforating gun from the normal fully-loaded amount, an enhanced dynamic underbalance effect is achieved. By using reactive shaped charges, the present invention allows for the use of fewer charges (to enhance dynamic underbalance effects) and yet reduces the risk of low perforation efficiency. By induction of a second explosive event, reaction or release of energy immediately following detonation of a shaped charge, improved perforation efficiency and tunnel cleanout is achieved. Moreover, subsequent elimination of the crushed zone and relief of the stress cage surrounding the perforation tunnel is achieved. In further embodiments, by constructing the gun carrier of lighter grade steel or with a thinner wall thickness, the weight and cost of the gun carrier is reduced.

Figure 4:
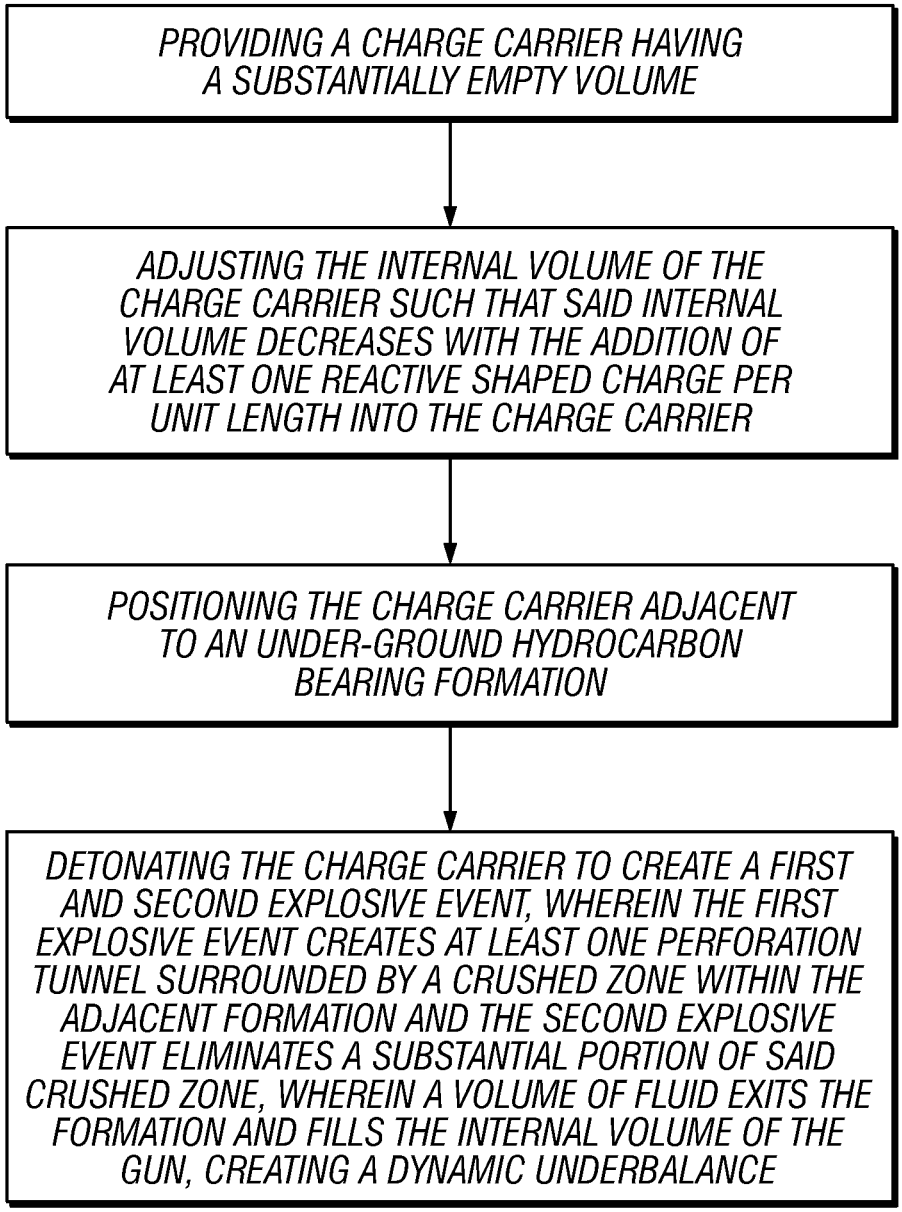
FIG. 4 depicts a flow chart generally illustrating the method of the present invention.

Generally, the improved method for perforating a well for the enhancement of dynamic underbalance in a perforating system, depicted in FIG. 4, comprises the steps of providing a charge carrier having a substantially empty internal volume; adjusting the internal volume of the charge carrier such that said internal volume decreases with the addition of at least one reactive shaped charge per unit length into the charge carrier; positioning the charge carrier within said charge carrier adjacent to an underground hydrocarbon bearing formation; detonating the shaped charge to create a first and second explosive event, wherein the first explosive event creates at least one perforation tunnel within the adjacent formation, said perforation tunnel being surrounded by a crushed zone, and wherein the second explosive event eliminates a substantial portion of said crushed zone, and further wherein a volume of fluid exits the formation and fills the internal volume of the gun, creating said dynamic underbalance.

Figure 5A:
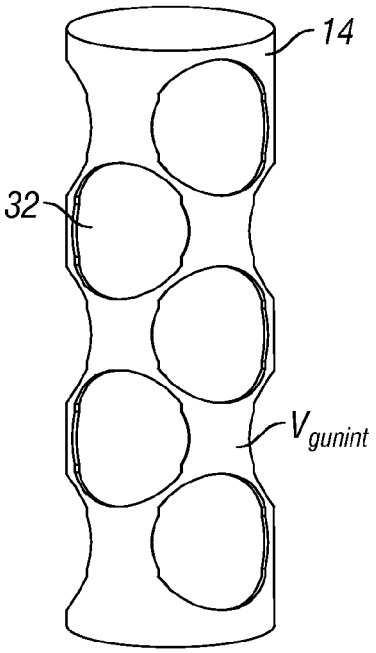
FIG. 5 depicts a hollow charge carrier with an internal free gun volume, which is manipulated in the present invention.
Figure 5B:
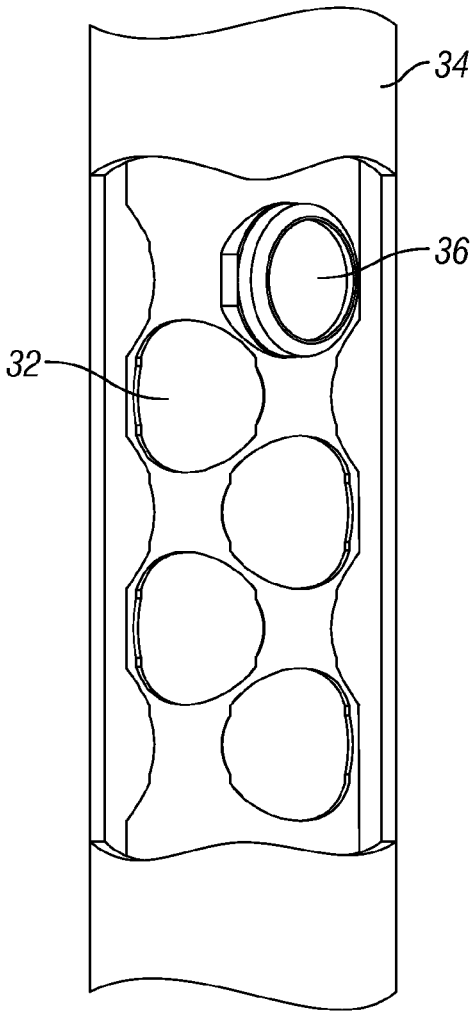

FIG. 5A depicts a hollow charge carrier 14 having a substantially empty internal gun volume, $V_{gun\ int}$. Open areas 32 of the charge carrier 14 are typically used as charge-receiving areas and comprise internal support components for receiving charges. Thus, as used herein, the substantially empty internal gun volume is meant to refer to a hollow charge carrier comprising internal support components for receiving charges without having yet been filled with any shaped charges, or having a substantially free internal gun volume comprising only internal support components for receiving charges. By introducing at least one reactive shaped charge 36 per unit length into the carrier 14, the internal gun volume $V_{gun\ int}$ is decreased and a loaded carrier capable of achieving an enhanced dynamic underbalance effect is produced. In other words, by loading the empty charge carrier 14, the volume within the carrier, or $V_{gun\ int}$, is reduced. The charge carrier can then be placed within a perforating system 36, as shown in FIG. 5B. Preferably, the perforating system is a perforation gun. Before detonation of the perforating system, the charge carrier is sealed at atmospheric pressure and the gun is introduced into a wellbore, adjacent to a formation. Following detonation of the gun and its reactive shaped charges, the greater volume within the charge carrier ultimately allows the carrier to accept more fluid from the formation, creating the dynamic underbalance effect. The second energy release caused by the reactive shaped charges aids in expelling debris from produced tunnels and in producing one or more tunnel depths substantially equal to the depth of penetration. In one embodiment, the pressure within the wellbore is less than that the pressure within the formation, thereby establishing a pressure differential. In one embodiment, this pressure differential is naturally produced within the formation. In another embodiment, the pressure differential is manufactured or man-made.

The internal volume of the carrier 14 is manipulated such that reactive shaped charges are introduced and yet the free internal gun volume $V_{gun\ int}$ remains greater than that of a fully loaded carrier. Thus, in one embodiment, at least one reactive shaped charge per unit length is introduced into a hollow charge carrier or, in an alternate embodiment, at least one reactive shaped charge per unit length is removed from a fully loaded charge carrier. Regardless of how the free volume is manipulated or how the number of reactive shaped charges is adjusted, so long as the $V_{gun\ int}$ remains greater than the volume of a fully loaded carrier (i.e., the charge carrier is only partially loaded), the present invention sustains an enhanced dynamic underbalance while shot density remains uncompromised.

In general, the larger the gun system, the more pronounced and sustained a dynamic underbalance effect becomes. Dynamic underbalance enhances the effectiveness of underbalanced perforating by prolonging the period during which flow is introduced from the formation, and by distributing the pressure drop more effectively across the perforated interval. By using reactive shaped charges, an improved effect is gained, which aids in overcoming limitations imposed in certain situations such as insufficient formation permeability or reservoir pressure.

Figure 6A:
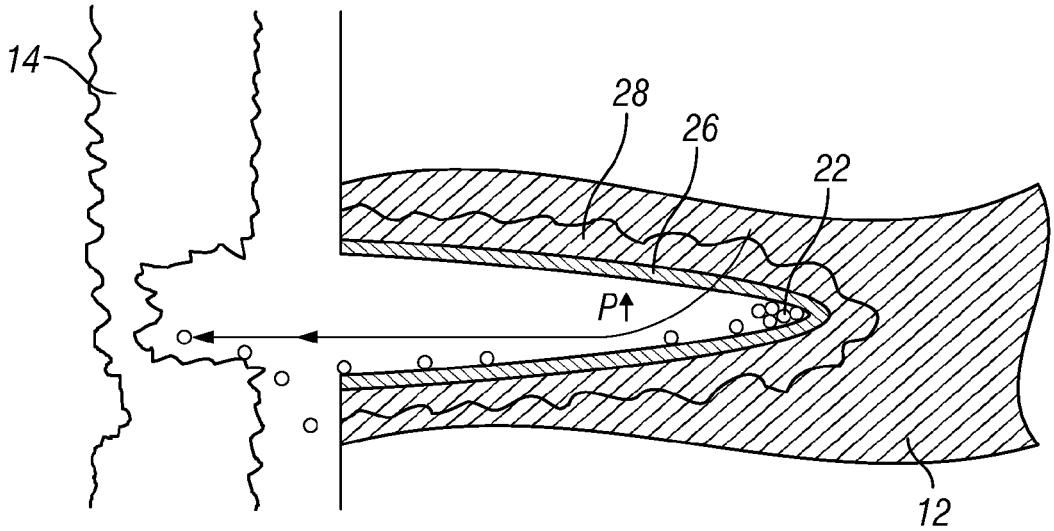
FIG. 6A is a cross-sectional close up view of a perforation tunnel created after a reactive charge is blasted into a hydrocarbon bearing formation.
Figure 6B:
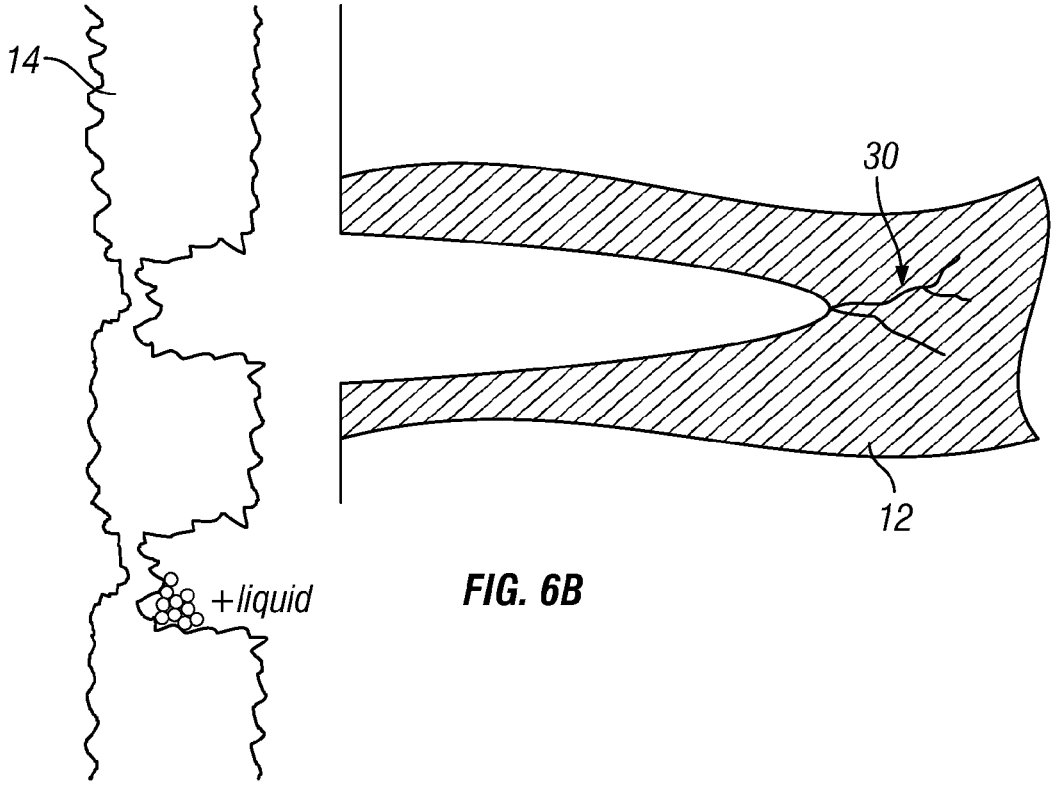
FIG. 6B is a cross-sectional close up view of the perforation tunnel of FIG. 6A and the wider and cleaner perforation tunnel experienced with the method of the present invention.

Without being bounded by theory, FIG. 6A depicts a close-up view cross-sectional view of a perforation tunnel created after a reactive shaped charge is blasted through a well casing and into a hydrocarbon bearing formation. Upon detonation, the activated reactive shaped is fired into the formation 12 and forms a tunnel surrounded by the crushed zone 26 as well as a zone of plastic deformation 28. FIG. 6B depicts one or more fractures 30, which are preferably created at the tip of at least one of the perforation tunnels as a result of the secondary, explosive event, which is substantially contained within the tunnel. As used herein, a fracture is a local crack or separation of a hydrocarbon bearing formation into two or more pieces. In addition, the crushed zone 26, discussed above in relation to the prior art methods, is eliminated, making the cross-sectional diameter of the perforation tunnel wider by at least one quarter inch, improving the geometry and quality of the tunnel. The stress cage 28 is also relieved, resulting in an overall improved perforation efficiency with an effective tunnel cleanout.

In prior art fully-loaded systems, which load the carrier with conventional charges, about 5-12 shaped charges per foot are deployed within a gun in an underbalanced system in order to achieve 1-6 effectively clean perforations per foot of gun in a rock formation, assuming typical 20-50% perforation efficiency. Typically, shot density is reduced by one to two shots per foot, or 15-20%. In contrast, by using reactive shaped charges, the second explosive event within a perforated tunnel effectively expels a substantial portion of debris from the tunnel, offsetting any risk of low perforation efficiency. Consequently, the second explosive event, reaction or release of energy, which is triggered by detonation of the reactive shaped charge in any number of ways, as discussed further below, decreases the risk of inefficient perforations seen with prior art charges.

An explosive event is meant to refer to a reaction that energy or heat including without limitation a reaction caused by one or more powders used for blasting, any chemical compounds, whether alone or in combination as a produced or formed mixture, and/or any other detonating agents, such as a reactive shaped charge. Detonation can be caused by ignition by fire, heat, electrical sparks, friction, percussion, concussion, or by detonation of the compound, mixture, device or any part thereof. The second explosive event remains substantially contained within each, individual perforated tunnel; thus, it may also be referred to as a "local" explosive event. In one embodiment, the second explosive event is a highly exothermic reaction. In one embodiment, the second explosive event is triggered by inducing one or more strong exothermic reactive effects to generate near-instantaneous overpressure within and around a tunnel. In one embodiment, the second explosive event is brought about by exploiting chemical reactions. In one embodiment, a chemical reaction between a metal within a charge carrier or perforation gun and an element within the formation is used to create an exothermic reaction within and around a perforation tunnel after detonation of a perforating gun. In one embodiment, the second explosive event occurs within 100 microseconds following detonation of the reactive shaped charge. In another embodiment, the second explosive event takes place within 200-300 microseconds following detonation of the reactive shaped charge. In either embodiment, the second explosive event occurs immediately after substantially complete formation of one or more perforation tunnels as a result of the first explosive event, or detonation of the reactive shaped charges.

In preferred embodiments, reactive effects are produced by reactive shaped charges having a liner manufactured partly or entirely from materials that will react inside the perforation tunnel, either in isolation, with each other, or with components of the formation. In one embodiment, the reactive shaped charges comprise a liner that contains a metal, which is propelled by a high explosive, projecting the metal in its molten state into the perforation created by the shaped charge jet. The molten metal is then forced to react with water that also enters the perforation, creating a reaction locally within the perforation. In another embodiment, the shaped charges comprise a liner having a controlled amount of bimetallic composition that undergoes an exothermic intermetallic reaction. In another embodiment, the liner is comprised of one or more metals that combine to produce an exothermic reaction after detonation.

Reactive shaped charges suitable for the present invention, for example, are disclosed in U.S. Pat. No. 7,393,423 to Liu and U.S. Patent Application Publication No. 2007/0056462 to Bates et al., the technical disclosures of which are both hereby incorporated herein by reference. Liu discloses shaped charges having a liner that contains aluminum, propelled by a high explosive such as RDX or its mixture with aluminum powder. Another shaped charge disclosed by Liu comprises a liner of energetic material such as a mixture of aluminum powder and a metal oxide. Thus, the detonation of high explosives or the combustion of the fuel-oxidizer mixture creates a first explosion, which propels aluminum in its molten state into the perforation to induce a secondary aluminum-water reaction. Bates et al. disclose a reactive shaped charge made of a reactive liner made of at least one metal and one non-metal, or at least two metals that form an intermetallic reaction. Typically, the non-metal is a metal oxide or any non-metal from Group III or Group IV, while the metal is selected from Al, Ce, Li, Mg, Mo, Ni, Nb, Pb, Pd, Ta, Ti, Zn, or Zr. After detonation, the components of the metallic liner react to produce a large amount of energy.

By way of example and without limiting the scope of the present invention, Table 1 below indicates the amount of empty (i.e., free) internal gun volume in various fully loaded systems. Shots per foot (SPF) refer to the number of shaped charges that can be mounted in a perforating gun in a given foot. For each charge that is introduced into the system, the free gun volume will decrease by some significant fraction of the volume described per individual charge. By the same manner, for each charge that is removed from a fully-loaded system, the free gun volume will increase by some significant fraction of the volume described per each individual charge. Volume associated with internal components used to support the charge cannot be entirely recovered.

TABLE 1

Free gun volume in various systems.

| Perforating Gun | Free Gun Volume | Volume per each individual charge |
|---|---|---|
| 4½" 5 SPF | 97.55 $in^3$/foot | 244.5 $in^3$ |
| 3⅜" 6 SPF | 42.51 $in^3$/foot | 171.0 $in^3$ |
| 2⅞" 6 SPF | 33.02 $in^3$/foot | 100.2 $in^3$ |

As shown in Table 1, a typical gun having an outside diameter of 4½ inches, loaded with five 39-gram charges per linear foot of gun will have a remaining free volume around the charges and associated supporting members of about 100 cubic inches per linear foot of gun. The removal of one shaped charge per foot adds more than 200 cubic inches of free volume, or between 200 and 250 cubic inches of free volume, thereby substantially enhancing the dynamic underbalance effect created by the system. Thus, removal of shaped charges, adds more free volume, or simply inclusion of less charges results in more free volume. In one embodiment, for example, utilizing a perforation gun providing 5 SPF, provides for an additional approximate 200 $in^3$/foot when only 4 shots per foot are utilized in the charge carrier; an additional approximate 400 $in^3$/foot when only 3 shots per foot are utilized in the carrier; and an additional approximate 600 $in^3$/foot when only 2 shots per foot are used. Further embodiments from the table above can be similarly determined.

Unlike conventional dynamic underbalance methods, there is no penalty or reduction of overall perforation efficiency from the removal of explosive charges. Since every shaped charge independently conveys a discrete quantity of reactive material into its tunnel, the cleanup of any particular tunnel is not affected by the others. The effectiveness of cleanup is thus independent of the prevailing rock lithology or permeability at the point of penetration.

In further embodiments, the weight of the perforating system can also be adjusted to an optimal weight, that is, one that is as light as possible without exceeding limits on swelling or causing gun failure. For example, most high performance guns are manufactured from high yield specialty steels such as G-130, G-135, or G-140. In one embodiment, a perforation gun is constructed of a lighter weight grade steel such as P-110. In another embodiment, the wall thickness of the gun is reduced. The specific values of initial wall thickness and selection of the steel will be system specific and will vary depending upon the amount of pressure rating and required gun swell. One skilled in the art, armed with this disclosure, can adjust these specific values based upon such factors as formation and wellbore pressures.

In addition, the propensity of the perforating gun to swell or split after detonation of the shaped charges conveyed therein is reduced by running fewer charges, lowering the risk of encountering problems when retrieving the spent gun. There is thus a significant advantage to be gained from this system, wherein one or more shaped charges can be removed or less charges can be used within a perforation gun without sacrificing the effective shot density created by the system. The shot density of a perforating gun system may be varied by adjusting the number of shaped charges within any given distance.

The improved method for perforating a wellbore described herein optimizes gun weight, enhances dynamic underbalance, and stimulates oil and gas production. Substantially eliminating the crushed zone around the perforation tunnels created by a perforating gun produces a much higher percentage of unobstructed tunnels with unimpaired tunnel walls in comparison to conventional methods; theoretically approaching 100% perforation efficiency. Consequently, as already discussed, fewer charges can be introduced into the charge carrier (i.e., the number of shaped charges within the perforating gun can be reduced) to create an enhanced method of achieving dynamic underbalance while delivering an effective shot density equivalent to or greater than that of a fully loaded perforating gun of conventional design.

By eliminating a substantial portion of the crushed zone, reactive perforators yield a number of benefits for oil and gas production. This includes a very high percentage of unobstructed tunnels with unimpaired tunnel walls, which results in: an increased rate of injection or production at a given pressure condition; a reduced injection pressure at a given injection rate; a reduced injection or production rate per open perforation (less erosion); an improved distribution of injected or produced fluids across the perforated interval; a reduced propensity for catastrophic loss of injectivity or productivity due to solids bridging (screen out) during long periods of production, slurry disposal or during proppant-bearing stages of an hydraulic fracture stimulation; the minimization of near-wellbore pressure losses; and an improved predictability of the inflow or outflow area created by a given number of shaped charges (of specific value to limited entry perforation for outflow distribution control).

Even though the figures described above have depicted all of the explosive charges as having uniform size, it is understood by those skilled in the art that, depending on the specific application, it may be desirable to have different sized explosive charges in the perforating system. It is also understood by those skilled in the art that several variations can be made in the foregoing without departing from the scope of the invention. For example, the particular location of the explosive charges can be varied within the scope of the invention. Also, the particular techniques that can be used to fire the explosive charges within the scope of the invention are conventional in the industry and understood by those skilled in the art.

It will now be evident to those skilled in the art that there has been described herein an improved perforating method that reduces the amount of debris left in the perforations in the hydrocarbon bearing formation after the perforating gun is fired, increases overall perforation efficiency and enhances dynamic underbalance within and around the perforating gun. Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A method for perforating a wellbore adjacent to an underground hydrocarbon bearing formation by using reactive shaped charges, the wellbore and formation being such that a maximum pressure gradient achievable between the formation and the wellbore, with minimum achievable hydrostatic pressure in the wellbore, is insufficient to create a cleaning surge flow when using conventional charges for creating perforated tunnels, the method including creating a dynamic underbalance around a charge carrier as a result of detonation of the reactive shaped charges, the dynamic underbalance of sufficient magnitude to create a cleaning surge flow, the method comprising the steps of:

a) providing a charge carrier having a substantially empty internal volume and comprising a plurality of cavities for receiving charges;

b) filling selective cavities of the charge carrier with charges comprising the reactive shaped charges having a liner component, the number of cavities filled being fewer than the total number of cavities, the number of filled cavities selected on enhancing the dynamic underbalance upon detonation to cause the cleaning surge flow of explosion debris from the formation to the charge holder;

c) sealing the cavities of the charge carrier to maintain pressure inside the charge carrier;

d) positioning the selectively filled and sealed charge carrier within the wellbore adjacent to said formation, wherein said wellbore has a first pressure substantially equal to a minimum hydrostatic pressure achievable in the wellbore and said formation has a second pressure, and wherein the pressure gradient is the difference between the first and second pressures, and the pressure gradient is of insufficient magnitude to clear the perforated tunnel by the cleaning surge flow if conventional charges were detonated to form the perforated tunnel;

e) detonating the reactive shaped charge of the charge carrier to create the perforated tunnel in the formation such that an explosive exothermic reaction takes place between materials comprising the liner component of the reactive shaped charge, and creating the dynamic underbalance;

f) creating the cleaning surge flow between the formation and the internal volume of the carrier under influence of the dynamic underbalance; and g) substantially clearing the perforated tunnel in the formation, the perforated tunnel substantially free of a crush zone which would otherwise be formed if conventional charges were used;

whereby, the method of detonating the reactive shaped charges has the effect of reducing shot density while providing a greater number of substantially cleared perforated tunnels as compared to detonating conventional charges.

2. The method of claim 1, wherein said detonating step causes a first and a second explosive event, the second explosive event substantially cleaning a tunnel depth substantially equal to the total depth of penetration of the perforated tunnel.

3. The method of claim 2 wherein said second explosive event occurs within 100 microseconds of said detonation.

4. The method of claim 2 wherein said second explosive event is substantially contained within a perforated tunnel.

5. The method of claim 2 wherein said second explosive event occurs within 200-300 microseconds of said detonation.

6. The method of claim 1 wherein the step of providing a charge carrier comprises providing a charge carrier of a grade of steel other than G-130, G-135, or G-140.

7. The method of claim 1 wherein the step of detonating such that explosive reaction takes place, results in projecting molten metal of the liner components into the perforated tunnel created by the reactive shaped charges.

8. The method of claim 7, wherein the formation comprises water, the molten metal reacting with the water.

9. The method of claim 1 wherein the detonation further comprises two explosive events upon detonating; a first explosive event triggering a second reactive explosive event, the second explosive event comprising the explosive exothermic reaction.

10. A method for perforating a well for the enhancement of dynamic underbalance in a perforating system within a wellbore adjacent to an underground hydrocarbon bearing formation, the method improving inflow and outflow performance relative to performance achieved with conventional shaped charges, said method comprising the steps of:

a) providing a charge carrier having a substantially empty internal volume and comprising a plurality of cavities for receiving charges;

b) partially filling the charge carrier by filling only some selected cavities of the charge carrier with a charge comprising a reactive shaped charge having a liner component, the number of cavities filled selected based on enhancing the dynamic underbalance that causes surge flow of explosion debris from the formation to the charge holder, after charge detonation;

c) positioning the charge carrier within the wellbore adjacent to said formation, wherein said wellbore comprises a first pressure substantially equal to a minimum hydrostatic pressure achievable in the wellbore and said formation comprises a second pressure, the first pressure lower than the second pressure, and wherein a maximum pressure gradient between the first and second pressures is of insufficient magnitude to clear perforated tunnels by surge flow if conventional charges were used; and d) forming the perforated tunnels in the formation by detonating the reactive shaped charges to create a first explosive event and second explosive event, wherein the first explosive event creates the perforated tunnels within the adjacent formation, and wherein the second explosive event is created by an explosive exothermic reaction between materials comprising the shaped charge liner component, the second explosive event substantially clearing the perforated tunnels formed in the formation by the first explosive event;

whereby, the use of the reactive shaped charges results in the surge flow as compared to conventional explosive charges thereby substantially freeing the perforated tunnels of a crush zone, resulting in enhanced hydrocarbon production from the formation.

11. The method of claim 10 wherein said second explosive event occurs within 100 microseconds of said detonation.

12. The method of claim 10 wherein said second explosive event is substantially contained within the perforated tunnel.

13. The method of claim 10 wherein said second explosive event occurs within 200-300 microseconds of said detonation.

14. The method of claim 10 wherein the step of providing a charge carrier comprises providing a charge carrier of a grade of steel other than G-130, G-135, or G-140.

15. The method of claim 10 wherein the step of detonating such that explosive reaction takes place results in projecting molten metal of the liner components into the perforated tunnel created by the reactive shaped charges.

16. The method of claim 15 wherein the formation comprises water, the molten metal reacting with the water.

17. A method for perforating a wellbore with a perforating system within the wellbore adjacent to an underground hydrocarbon bearing formation, the method improving inflow and outflow performance relative to performance achieved with conventional shaped charges, said method comprising the steps of:

a) selecting a wellbore wherein a maximum pressure gradient achievable between the formation and the wellbore, with minimum achievable hydrostatic pressure in the wellbore, is insufficient to create a cleaning surge flow when using conventional charges for creating perforated tunnels;

b) providing a charge carrier having a substantially empty internal volume and comprising a plurality of cavities for receiving charges;

c) filling selective cavities of the charge carrier with a charge comprising a reactive shaped charge having a liner component into the charge carrier, the number of cavities filled selected based on enhancing an underbalance effect that causes back flow of explosion debris from the formation to the charge carrier, after the charges are detonated, and based on maintaining effective shot-density compared to a fully loaded charge carrier;

d) positioning the selectively filled charge carrier within the wellbore adjacent to the formation, wherein said wellbore has a first pressure substantially equal to a minimum hydrostatic pressure achievable in the wellbore and said formation comprises a second pressure higher than the first pressure, and the formation comprising water therein; and e) forming the perforated tunnels in the formation by detonating the charge carrier to create a first and second explosive event, wherein the first explosive event creates the perforated tunnels within the adjacent formation, and wherein the second explosive event is created by an explosive exothermic reaction between materials comprising the shaped charge liner component, the second explosive event resulting in projecting molten metal of the liner component into the perforated tunnels created by the reactive shaped charges, the molten metal reacting with the water in the formation thereby substantially clearing the perforated tunnels formed in the formation by the first explosive event, the second explosive event substantially confined within the perforated tunnels;

whereby, the method provides a higher effective shot density relative to detonating a charge carrier without the reactive shaped charges, while reducing shot density, and the method creates a dynamic underbalance around the charge carrier as a result of detonation of the reactive shaped charges, the dynamic underbalance of sufficient magnitude to create the cleaning surge flow.

* * * * *